US011505372B2

(12) United States Patent
Bloom et al.

(10) Patent No.: US 11,505,372 B2
(45) Date of Patent: Nov. 22, 2022

(54) RETAINABLE CLOSURE

(71) Applicant: Berry Global, Inc., Evansville, IN (US)

(72) Inventors: Daniel A. Bloom, Bowling Green, OH (US); Kenneth S. Bloom, Bloomdale, OH (US); Andrew Kreinbrink, Toledo, OH (US)

(73) Assignee: Berry Global, Inc., Evansville, IN (US)

( * ) Notice: Subject to any disclaimer, the term of this patent is extended or adjusted under 35 U.S.C. 154(b) by 0 days.

(21) Appl. No.: 17/038,377

(22) Filed: Sep. 30, 2020

(65) Prior Publication Data

US 2021/0094733 A1 Apr. 1, 2021

Related U.S. Application Data

(60) Provisional application No. 62/907,816, filed on Sep. 30, 2019.

(51) Int. Cl.
*B65D 41/34* (2006.01)
*B65D 55/16* (2006.01)

(52) U.S. Cl.
CPC ..... *B65D 41/3409* (2013.01); *B65D 55/16* (2013.01)

(58) Field of Classification Search
CPC . B65D 41/3409; B65D 55/16; B65D 41/3428
See application file for complete search history.

(56) References Cited

U.S. PATENT DOCUMENTS

| | | | | |
|---|---|---|---|---|
| 3,904,062 | A | 9/1975 | Grussen | |
| 4,394,618 | A | 7/1983 | Maiko | |
| 5,984,123 | A | 11/1999 | Mogami et al. | |
| 6,474,491 | B1 * | 11/2002 | Benoit-Gonin | B65D 41/3428 220/263 |
| 8,469,213 | B2 | 6/2013 | Ishii et al. | |
| 8,794,460 | B2 | 8/2014 | Druitt et al. | |
| 9,010,555 | B2 | 4/2015 | Luzzato et al. | |
| 9,108,774 | B2 | 8/2015 | Kwon | |
| 10,625,914 | B2 | 4/2020 | Wang et al. | |
| 10,654,324 | B2 | 5/2020 | Fredenburg | |
| 10,654,625 | B2 * | 5/2020 | Migas | B65D 1/0246 |
| 10,836,544 | B2 | 11/2020 | Kim | |
| 10,836,549 | B2 | 11/2020 | Maguire | |
| 2011/0114593 | A1 | 5/2011 | Ishii et al. | |
| 2011/0174760 | A1 * | 7/2011 | Luzzato | B65D 41/48 215/258 |
| 2012/0024815 | A1 * | 2/2012 | Kwon | B65D 41/3409 215/272 |
| 2012/0285921 | A1 | 11/2012 | Kwon | |
| 2018/0079570 | A1 | 3/2018 | Maguire | |
| 2019/0344944 | A1 | 11/2019 | Maguire | |
| 2019/0375555 | A1 | 12/2019 | Edie et al. | |

(Continued)

FOREIGN PATENT DOCUMENTS

| | | |
|---|---|---|
| EP | 3277598 A1 | 2/2018 |
| EP | 3277598 B1 | 6/2020 |

(Continued)

OTHER PUBLICATIONS

Search Report and Written Opinion of corresponding International Application No. PCT/US2020/053503 dated Dec. 15, 2020, all enclosed pages cited.

*Primary Examiner* — Shawn M Braden

(57) ABSTRACT

A closure that is retainable with a container is disclosed.

10 Claims, 9 Drawing Sheets

(56) References Cited

U.S. PATENT DOCUMENTS

| | | | | |
|---|---|---|---|---|
| 2020/0017260 | A1 | 1/2020 | Migas et al. | |
| 2020/0207525 | A1* | 7/2020 | Sung | B65D 47/0871 |
| 2020/0369446 | A1* | 11/2020 | Melan-Moutet | B65D 55/16 |

FOREIGN PATENT DOCUMENTS

| | | | |
|---|---|---|---|
| JP | 5341729 | B2 | 8/2013 |
| JP | 5866249 | B2 | 1/2016 |
| KR | 10-0981240 | B1 | 9/2010 |
| WO | 2016182305 | A1 | 11/2016 |
| WO | 2019177616 | A1 | 9/2019 |
| WO | 2019238988 | A1 | 12/2019 |
| WO | 2020037010 | A1 | 2/2020 |
| WO | 2020050823 | A1 | 3/2020 |
| WO | 2020093058 | A2 | 5/2020 |
| WO | 2020099200 | A1 | 5/2020 |
| WO | 2020099516 | A1 | 5/2020 |
| WO | 2020093058 | A3 | 7/2020 |
| WO | 2020144182 | A1 | 7/2020 |
| WO | 2020156847 | A1 | 8/2020 |
| WO | 2020157695 | A1 | 8/2020 |
| WO | 2020178012 | A1 | 9/2020 |
| WO | 2020182852 | A1 | 9/2020 |
| WO | 2020182854 | A1 | 9/2020 |
| WO | 2020193821 | A1 | 10/2020 |
| WO | 2020201227 | A1 | 10/2020 |
| WO | 2020212426 | A1 | 10/2020 |
| WO | 2020227813 | A1 | 11/2020 |
| WO | 2020229134 | A1 | 11/2020 |
| WO | 2020240518 | A1 | 12/2020 |

* cited by examiner

RETAINABLE CLOSURE

PRIORITY CLAIM

This application claims priority under 35 U.S.C. § 119(e) to U.S. Provisional Application Ser. No. 62/907,816 filed Sep. 30, 2019, which is expressly incorporated by reference herein.

TECHNICAL FIELD

The present disclosure relates generally to a closure, and more specifically to a retainable closure for a container.

BACKGROUND

It is often desirable to store product or contents in a container or package. It is often desirable to close the container with a closure. A closure may be provided that will stay connected and/or be retainable to a container after opened. A closure may be provided with tamper evident features.

SUMMARY

Certain embodiments according to the present disclosure provide a closure that is retainable to a container. The closure may be configured such that it has tamper evident features and remains with a corresponding container after opening.

In one aspect, for instance, a closure for a bottle is provided having a cover and a skirt depending from the cover. The closure includes a tamper band, and the skirt is disposed between the cover and the tamper band. A first separation area, such as a score for example, extends horizontally around a portion of a circumference of the skirt. At least one second separation area, such as one or more vertical scores, extends below the first separation area. A pair of hinges may be disposed oppositely a tab. The tab may be configured to have an outer surface that contacts the bottle when the closure is an open position to retain the closure in the open position. The pair of hinges define a hinge axis about which at least a portion of the closure moves between the open position and a closed position in which the closure blocks access to the bottle. The pair of hinges also allows movement of the closure between the closed position and the open position and also retain the skirt to the tamper band.

In another aspect, for instance, a closure for a container is providing having a cover and a skirt depending from the cover, as well as a tamper band, wherein the skirt is disposed between the cover and the tamper band. A first separation area may extend horizontally around at least about half the circumference of the skirt. A pair of vertical scores may be formed in the tamper band and extend below the first separation area to at least partially define a tab. The pair of vertical scores may extend toward the bottom of the tamper band. A pair of hinges may be disposed between the pair of vertical scores and the first separation area. The closure may be configured to rotate about a hinge axis that extends through the pair of hinges between a closed position in which the cover blocks access to the container and an open position in which the cover allows discharge of contents from the container. The tab is configured to engage the container when the closure is in the open position to retain the closure in the open position. The pair of hinges allow movement of the closure between closed position and the open position and also retain the skirt to the tamper band.

In yet another aspect, for instance, a closure for a container is provided having a cover and a skirt depending from the cover. A tamper band may be provided, wherein the skirt is disposed between the cover and the tamper band. The cover, skirt, and tamper band are injection molded or compression molded. A first separation area extends horizontally around a portion of a circumference of the closure between the skirt and the tamper band. A first vertical score and a second vertical score extend downwardly below the first separation area toward a bottom edge of the tamper band to form a tab between the first vertical score and the second vertical score. At least one of the first separation area, the first vertical score, and the second vertical score are formed by at least one of a cutting operation and a slitting operation. A pair of hinges are disposed between the pair of vertical scores and the first separation area. The closure is configured to rotate about a hinge axis that extends through the pair of hinges between a closed position in which the cover blocks access to the container and an open position in which the cover allows discharge of contents from the container. The tab is configured to engage the container when the closure is in the open position to retain the closure in the open position. The pair of hinges allow movement of the closure between the closed position and the open position and also retain the skirt to the tamper band.

BRIEF DESCRIPTION OF THE DRAWINGS

Embodiments now will be described more fully hereinafter with reference to the accompanying drawings, in which some, but not all embodiments may be shown. Indeed, embodiments may be illustrated or described in many different forms and the present disclosure should not be construed as limited to the embodiments set forth herein. Like numbers refer to like elements throughout, and wherein.

DETAILED DESCRIPTION

Embodiments now will be described more fully hereinafter with reference to the accompanying drawings, in which some, but not all embodiments may be shown. Indeed, embodiments may take many different forms and the present disclosure should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The terms "substantial" or "substantially" may encompass the whole as specified, according to certain embodiments, or largely but not the whole specified according to other embodiments.

Figure 1:
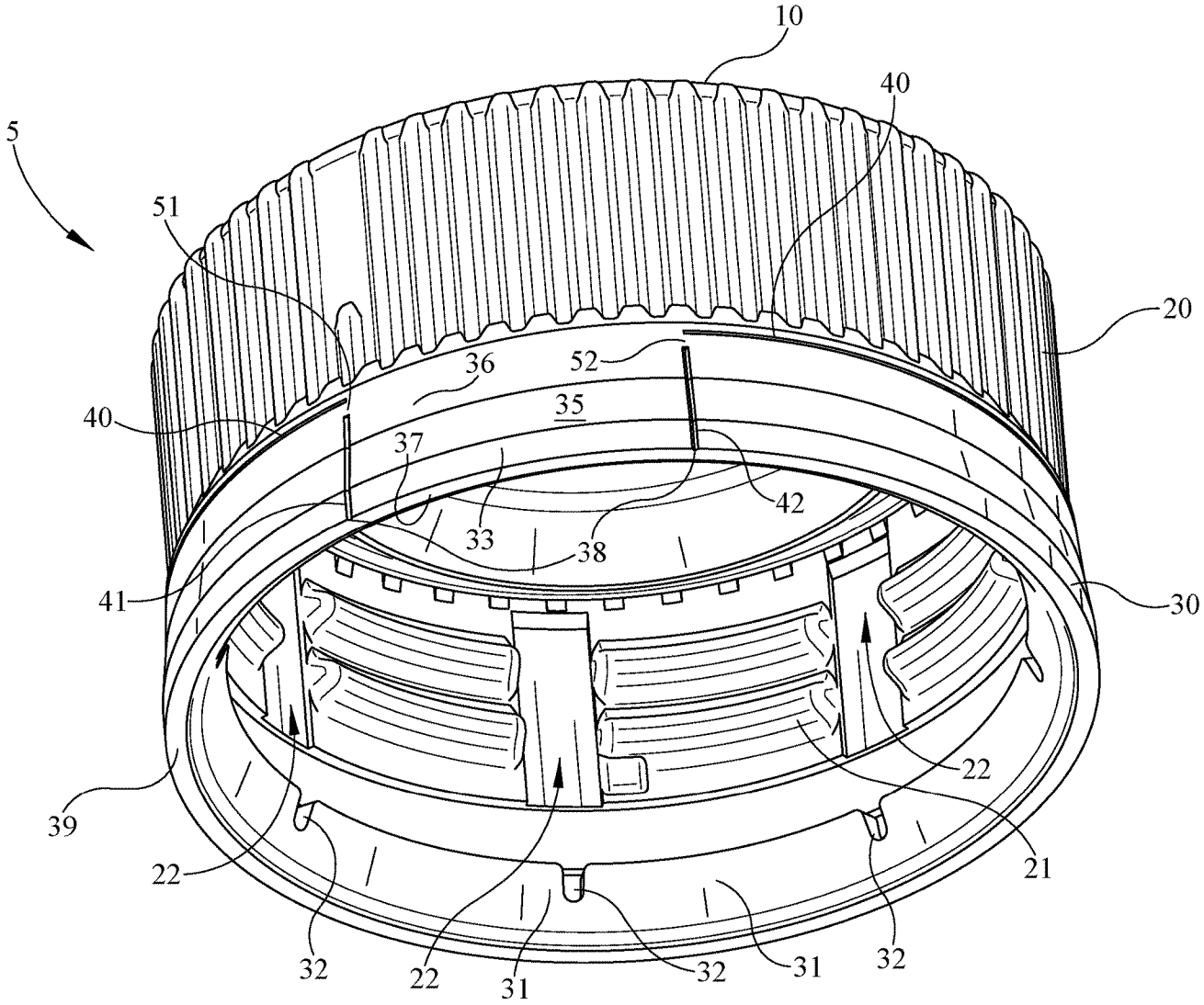
FIG. 1 illustrates a bottom perspective view of an embodiment of a closure.

Some embodiments of a closure 5 may include a lid or cover 10 and/or a skirt 20, as shown for example in FIG. 1. Lid 10 may be configured to substantially block access to anything in, under, and/or covered by lid 10, such as a product storage region within a container. Skirt 20 may depend from lid 10 and may include an attachment feature such as an internal thread 21 for attachment to a container to be covered by closure 5. Lid 10 may include one or more sealing features, which may be, for example, of the plug fit or friction fit type, and/or a seal, gasket, liner, or the like.

Figure 2:
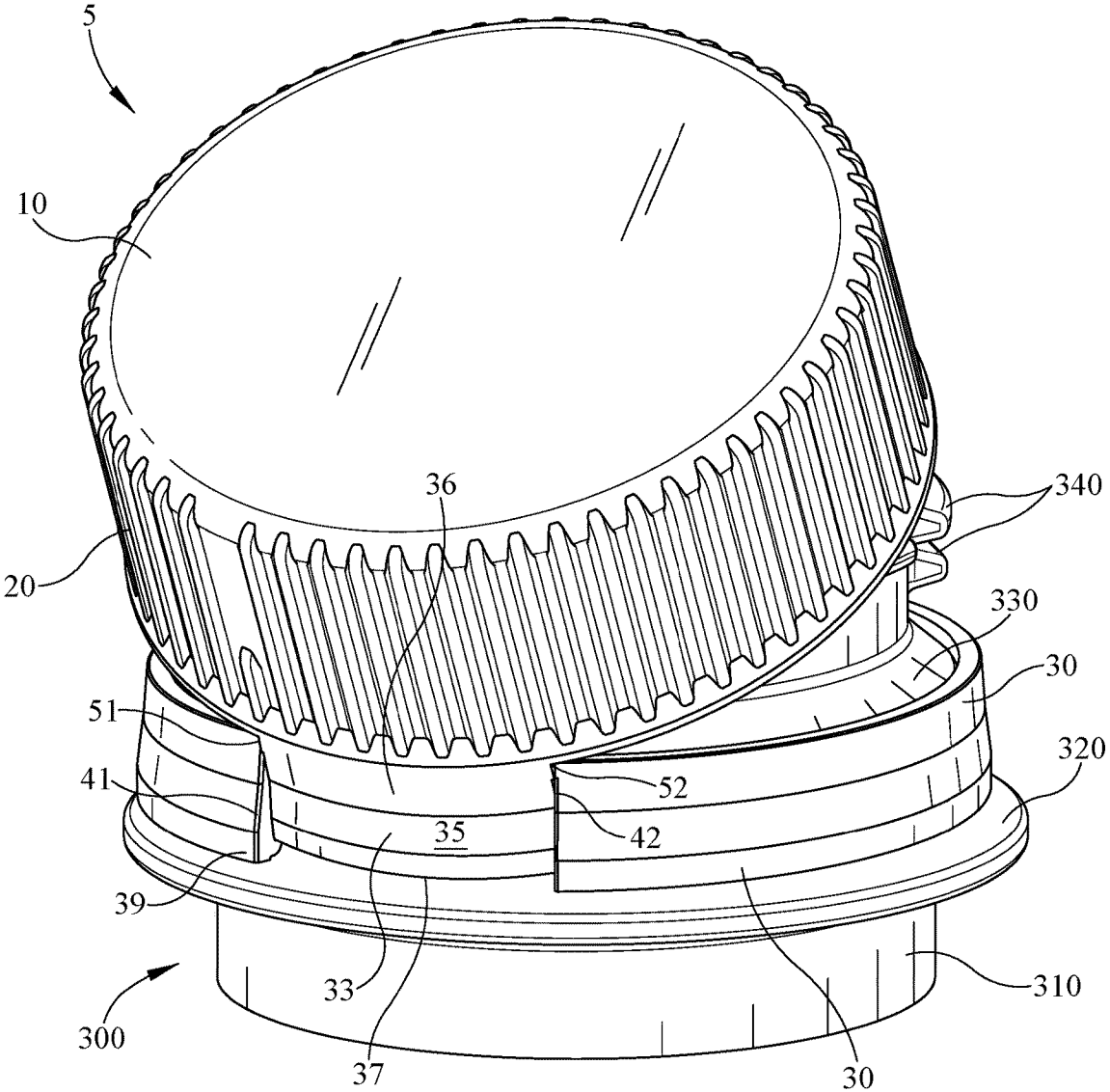
FIG. 2 illustrates a top perspective view of the closure of FIG. 1 in a first open position relative to a container or bottle neck.
Figure 3:
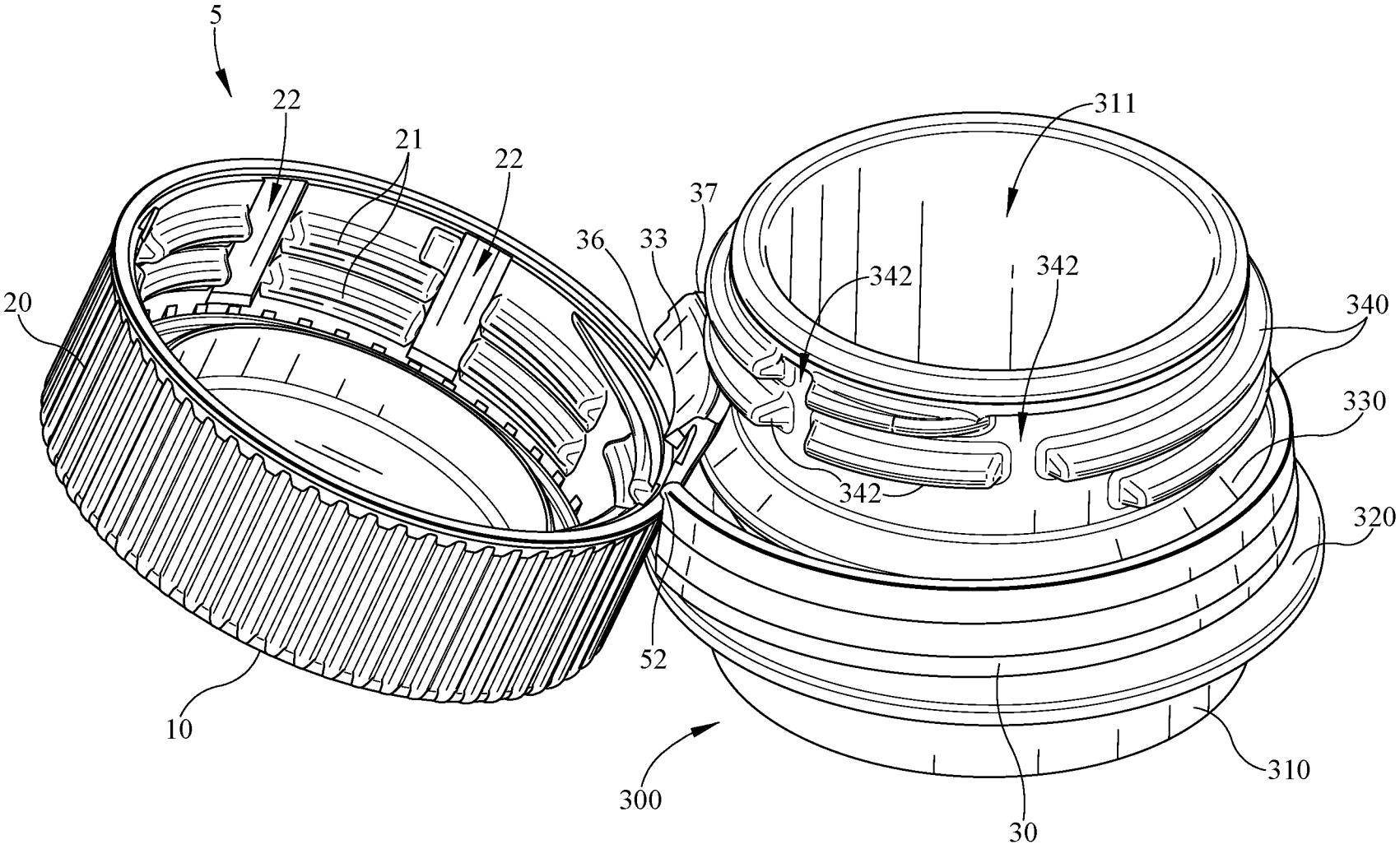
FIG. 3 illustrates a top perspective view of the closure of FIG. 2 in a second open position relative to the bottle neck.

Closure 5 may include a tamper band 30, as shown for example in FIGS. 1 through 3, which may be configured to at least partially separate from the rest of closure 5 when removed from an underlying bottle or container 300. Tamper band 30 may partially separate from skirt 20, for example, to allow closure 5 to be moved between an open position and a closed position relative to container 300, while staying partially connected to skirt 20 and/or another portion of closure 5 to allow closure 5 to remain attached, coupled, and/or retained to container 300 via tamper band 30. Closure 5 and/or tamper band 30 may provide a visual indication to a user that closure 100 has been removed from bottle or container 300 by virtue of the separation of tamper band 30 from the rest of closure 5 and/or skirt 20. Tamper band 30 and/or closure 100 may include a plurality of segments 31 and/or scallops 32 to facilitate attachment and/or tamper evident removal of closure 5 from bottle or container 300, or for any other reason. Closure 5 and/or any portion thereof may be configured to be removably attachable to container 300. For example, closure 5 may include one or more internal threads 21 that may be configured to engage corresponding external threads 340 of container 300. If included, either or both threads 21, 340 may include one or more vents 22, 342, which may be provided, for example, to facilitate alleviating, equalizing, and/or slowly releasing pressure that may build up in container 300. At least a portion of tamper band 30, such as one or more segments 31 may extend downwardly prior to attachment of closure 5 to container 300, such as during a capping operation on a beverage line, for example, and/or may be folded or inverted upwardly as shown in FIG. 1 to facilitate holding and/or retaining tamper band 30 to container 300 as discussed in more detail below. Scallops 32, if included, may facilitate folding, inverting, retention, and/or other aspect of tamper band 30.

Figure 4:
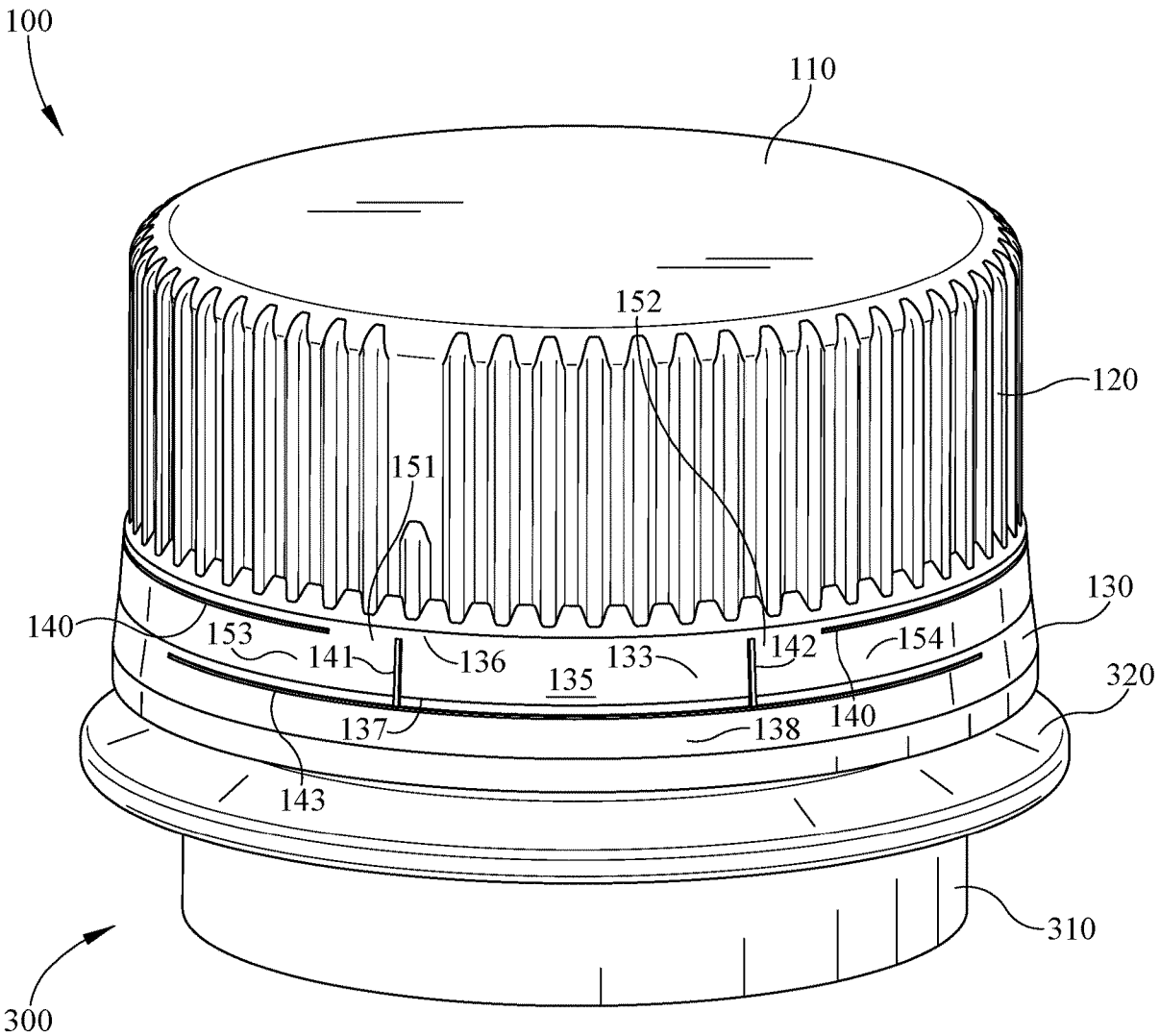
FIG. 4 illustrates a top perspective view of another embodiment of a closure in a closed position relative to a container neck.
Figure 7:
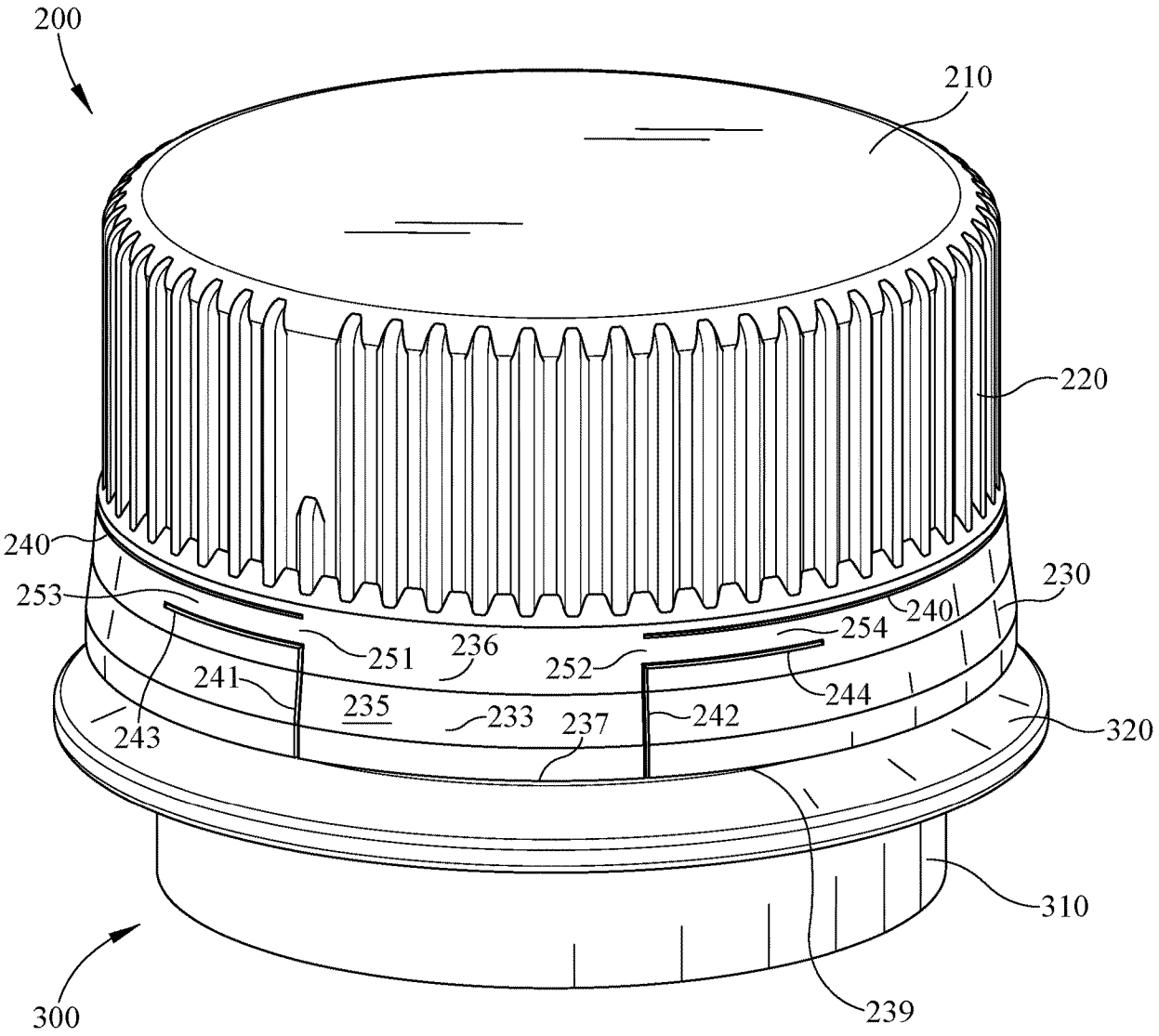
FIG. 7 illustrates a top perspective view of yet another embodiment of a closure in a closed position relative to a bottle or container neck.

Container 300 may include a neck 310 that defines an opening 311 through which contents may be dispensed and/or poured, as shown for example in FIGS. 2 and 3. It is understood that only a portion of container 300 is shown, and any of a variety of containers or bottles 300 may be used, such as, for example, any of a variety of beverage bottles or containers. Container 300 may include any or all of a transfer ring or flange 320 and a bead 330. Transfer ring or flange 320 may be provided for any of a variety of reasons, including but not limited to providing an area or surface that molding, bottling, capping, and/or conveying equipment may hold, for example, as the bottle is formed, filled, capped for example with closure 5 (or 100 as shown in FIG. 4 or 200 as shown in FIG. 7), and/or transported. It is understood that transfer ring or flange 320 is optional, and in some embodiments container 300 may be formed without flange 320 or with a different feature instead of or in addition to flange 320. Flange 320, if included, may be configured so that it is relatively close to the bottom of closure 5 and/or the tamper band 30 (or 130 as shown in FIG. 4 or 230 as shown in FIG. 7) to help prevent or inhibit tampering with closure 5 by minimizing the space between closure 5 and flange 320. Flange 320 may also or alternatively be configured with enough space between it and the bottom of closure 5 and/or tamper band 30 when closure 5 is installed on container 300 (e.g., during capping) to ensure that the installation or attachment of closure 5 and/or any portion thereof is not inhibited by contact with flange or transfer ring 320. Closure 5, tamper band 30, and/or flange or transfer ring 320 may be sized, shaped, oriented, and/or configured to minimize the space between closure 5 and transfer ring 320 while also ensuring enough space to prevent interference of the transfer ring 320 and closure 5 during capping and/or otherwise.

Bead 330 may project outwardly from container neck 310 and/or may engage tamper band 30 and/or tamper band segments 31 to prevent or inhibit tamper band 30 from traveling vertically upward relative to container neck 310. Removal of closure 5 from container 300, for example by rotating to unthread, may cause vertical upward motion relative to container 300. Closure 5 and/or a portion thereof, such as for example skirt 20, may separate from at least a portion of tamper band 30 during unthreading for instance due to the upward motion caused by unthreading skirt 20 contemporaneously with the blocking of upward motion by bead 330.

To facilitate separation of skirt 20 from tamper band 30 while also allowing skirt 20 to remain attached or connected to tamper band 30, or for any other reason, closure 5 may include one or more separation areas or features such as a first area of weakened material or first score 40 and/or one or more second separation areas such as scores, for example, such as a first vertical score 41 and a second vertical score 42, as shown for example in FIG. 1. The second separation areas may be formed with frangible material, weakened material, or no material. First score 40 may be a substantially horizontal score that extends around some of the circumference of closure 5 with an area of material between. It is understood that first score 40 may be configured other than horizontally as shown in FIG. 1, for example, by extending at an angle relative to the horizontal. Second scores 41, 42 may be substantially transverse and/or perpendicular to first score 40 to leave an area of material between them and first score 40. Any or all of scores 40, 41, 42 may be areas or lines of thinned material, frangible material, weaker material, no material, any combination thereof, and/or configured to be more easily separable than surrounding areas of material. It is further understood that, while second or vertical scores 41, 42 may be scored into closure 5, skirt 20, and/or tamper band 30, they may be formed otherwise and/or provide areas of weakened material or frangible material, breaks or gaps in material, or otherwise facilitate separation where they are located. Scoring is one example of how separated or relatively easy separation of one area from another may be achieved. Vertical scores 41, 42 may be angled relative to a vertical direction and/or may be configured with a vertical component as well as a horizontal component. The areas of material between the respective scores may create one or more flaps, bridges, and/or hinges such as a first hinge 51 and a second hinge 52, which may be configured to stay connected while the separation areas 40, 41, and/or 42 provided separation of adjacent areas.

Scores 40, 41, 42 and/or hinges 51, 52 may facilitate moving closure 5 between an exemplary closed position shown in FIG. 1 and one or more exemplary open positions such as a first open position or partially open position shown in FIG. 2 and/or a second open position or fully open position shown in FIG. 3. In an open position, the cover may be out of alignment with neck opening 311 and/or allow discharge of contents from container 300. In a closed position, the cover may substantially block, prevent and/or inhibit access to and/or discharge of contents from container 300 and/or neck opening 311. For example, a user may twist open closure 5 causing separation of skirt 20 from band 30 at or near horizontal score 40, which may be weaker and/or more easily separable than surrounding areas of skirt 20 and band 30. Horizontal score 40 could be substantially devoid of material, could include thinned or weakened material such as a web, and/or may include one or more frangible connections that connect skirt 20 to band 30 in one or more places. The user may then rotate closure 5 relative to container 300 into the open position shown in FIG. 3 by rotating skirt 20 relative to band 30 and/or container 300 about either or both hinges 51, 52. Either or both hinges 51, 52 may stretch and/or twist to accommodate moving closure 5 between the closed position, the first open position, and/or the second open position. For example, either or both hinges 51, 52 may be formed of a stretchable and/or flexible thermoplastic material such as polypropylene (PP) and/or high-density polyethylene (HDPE), for example.

Rotation of skirt 20 about a hinge axis extending through hinges 51, 52 relative to band 30 may result in an inverted portion or tab 33 that may flip upwardly as shown in FIG. 3. Tab 33 may be provided between first hinge 51 and second hinge 52, and/or may be provided between first vertical score 41 and second vertical score 42, may extend from a tab bottom portion 37 to a tab top portion 36, and/or may include material from a portion of at least one of skirt 20 and band 30. Tab 33 may rotate and/or invert about hinge axis substantially along a line formed through first hinge 51 and second hinge 52. Tab 33 may include an outer surface 35 that may engage and/or contact container 300, for example at bead 330 and/or thread 340, when in the open position shown. Contact or engagement of tab 33 with bead 330 and/or container 300 may facilitate retaining closure 5 and/or skirt 20 in the open position, for example, by resisting rotation to flip closure 5 back into the closed position. Closure 5 may be configured such that a user may overcome this resistance and selectively close closure 5 relative to container 300 and/or move closure 5 into the closed position shown for example in FIG. 1.

Either or both hinge 51, 52 may stretch or be stretched in the open position and/or during transition between open and closed positions. This stretching may induce tension and/or bias that may facilitate retention in the open position and/or closed position, for example, by increasing friction between tab 33 and/or outer surface 35 and bead 330. Such tension may provide or enhance a snap back type hinging mechanism and/or facilitate or provide audible and/or haptic feedback such as a click to a user when tab 33 locks or snaps into the open position. One or more areas of material such as bridges 38 may be provided to connect and/or provide a frangible connection between tab 33 and the rest of tamper band 30. For example, one or more bridges 38 may connect tab bottom 37 to tamper band bottom 39, although it is understood that one or more bridges 38, if included, may be located elsewhere, for example, higher up in first vertical score 41 and/or second vertical score 42. Either or both of vertical scores 41, 42 may extend substantially to the bottom 39 of tamper band 30 and/or the bottom o37 of tab 33. As discussed herein, extend substantially to the bottom 37 or bottom 39 may include embodiments including one or more bridges 38 and/or areas of frangible material located in and/or across scores 41, 42.

Figure 5:
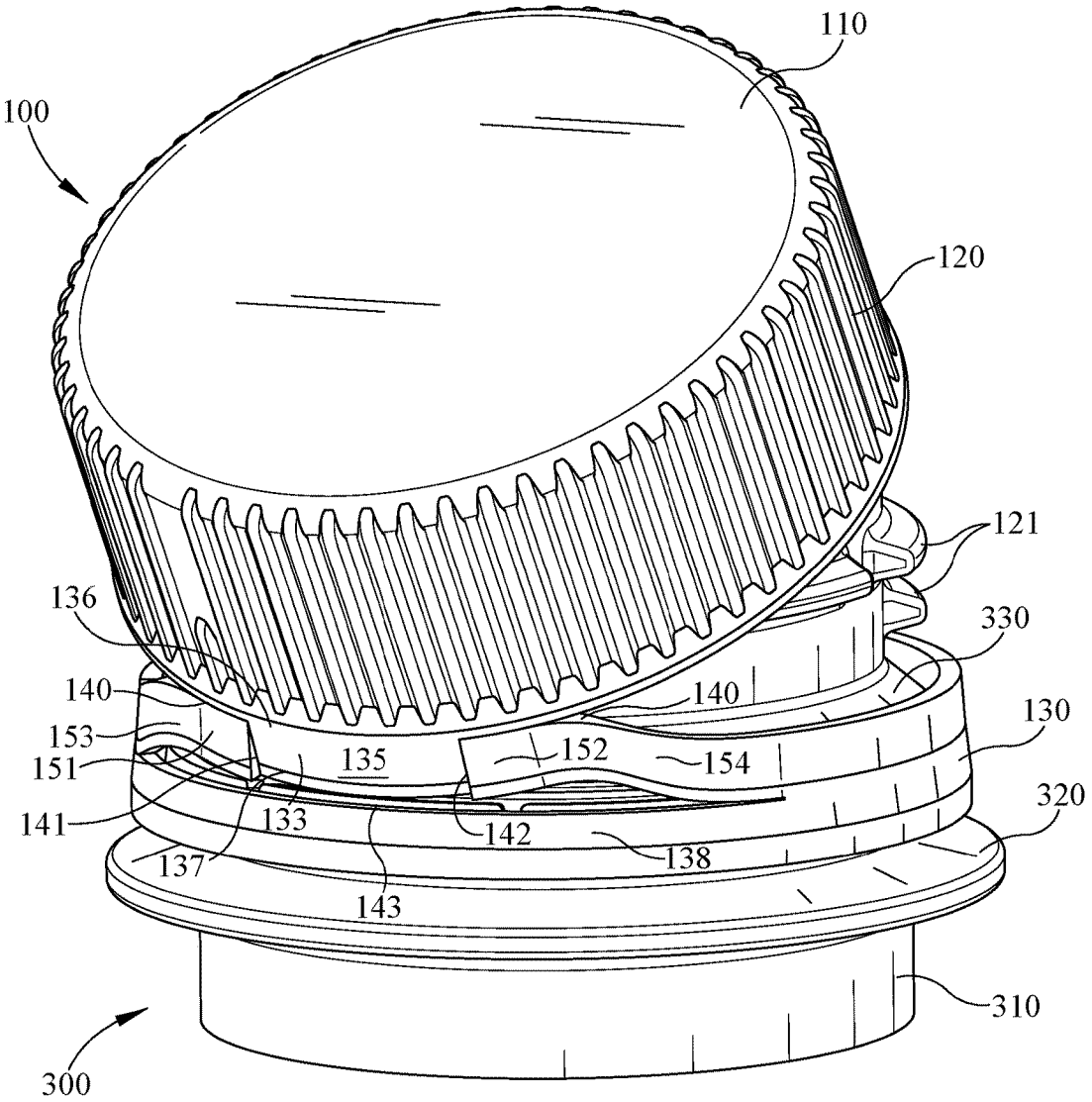
FIG. 5 illustrates a top perspective view of the closure of FIG. 4 in a first open position relative to the container or bottle neck.
Figure 6:
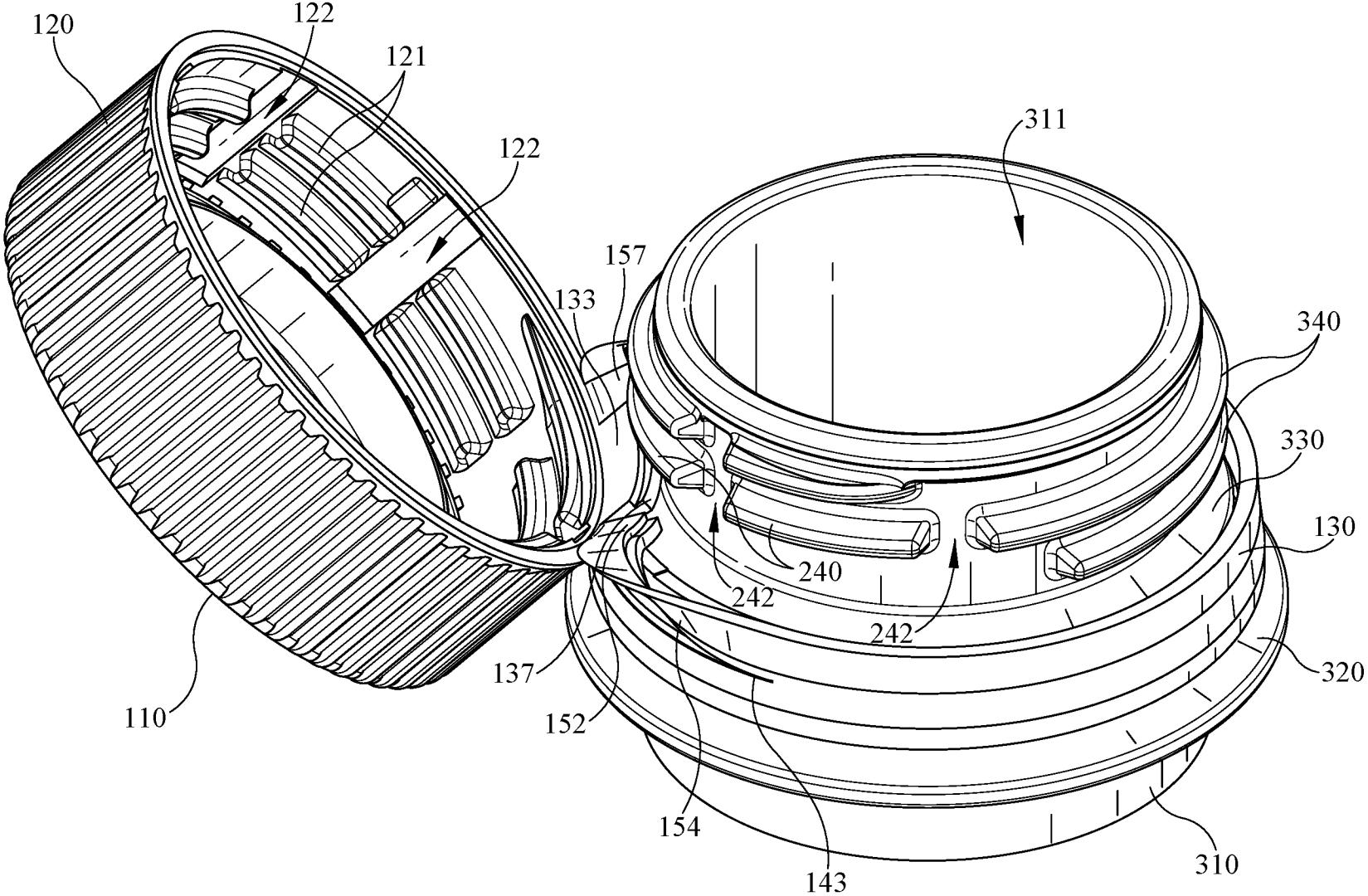
FIG. 6 illustrates a top perspective view the closure of FIG. 5 in a second open position relative to the container or bottle neck.

A second embodiment of a closure 100 is illustrated in FIGS. 4-6. Closure 100 may have a cover 110, a skirt 120 depending downwardly therefrom, and/or a tamper band 130. Closure 100 may be configured and/or operate similarly to closure 5, although it is understood there may be differences between closure 100 and closure 5. For instance, closure 100 may have a substantially horizontal first separation area, which may be formed of weakened material or no material, such as first score 140 and/or a substantially horizontal third separation area of weakened material or no material such as second score 143. Either or both of first score 140 and second horizontal score 143 may include areas of weakened material or no material, which may be provided in a variety of ways, including but not limited to scoring, perforating, providing areas of thin material or webs, or any combination thereof. Substantially unscored and/or relatively unweakened areas of material may be provided to facilitate formation of hinges such as hinges 151, 152, as shown for example in FIG. 4. Tamper band 130 and/or closure 100 may include a plurality of segments and/or scallops (e.g., similar to segments 31 and/or scallops 32 shown in FIG. 1).

As shown in FIG. 5, closure 100 may be provided in a partially open position or a first open position, which may occur for example when a user provides an input to open closure 100 relative to container 300, such as for example twisting or unthreading closure 100 and/or closure skirt 120 relative to container 300. In embodiments wherein skirt 120 and container 300 engage one another via threads or the like, rotation may cause vertical or upward movement of closure 100 and/or skirt 120 relative to container 300 and/or tamper band 130, because tamper band 130 and/or internal segments (not shown but could be similar to segments 31 of FIG. 1, for example) may abut bead 330 to prevent upward or vertical movement thereof. Skirt 120 or a portion thereof may separate from band 130 or a portion thereof, for example, at either or both of first score 140 and second horizontal score 143. Unscored or unweakened portions or areas of material may be provided between score 140 or a portion thereof and score 143 or a portion thereof, for example, to provide first hinge 151 and/or second hinge 152, as discussed above, for example.

To facilitate moving closure 100 between a closed position and one or more open positions, or for any other reason, a first strap 153 and/or a second strap 154 may be included. Either or both straps 153, 154 may be provided to give extra length, rotation, and/or flexibility to the material that remains connected between tamper band 130 and skirt 120 even after separation at separation areas 140, 141, 142, and/or 143, which may allow extra movement of skirt 120 relative to tamper band 130 during opening and closing. First strap 153 and/or second strap 154 may be substantially defined at areas of circumferential overlap of first score 140 and second score 143 on top and bottom, respectively, at one end by the end of first or upper horizontal score 140, and/or at the other end by the end of second or lower horizontal score 143. Straps 153, 154 may be adjacent respective hinges 151, 152, or alternatively, straps 153, 154 may be considered to include respective hinges 151, 152, as may be the case for example, if straps 153, 154 extend to vertical scores 141, 142.

As shown in FIG. 6, for example, closure 100 may be provided in a second open position wherein it has been rotated, flipped, and/or inverted relative to container 300, for example, such that a user may access and/or drink from container 300. Hinges 151, 152 and/or straps 153, 154 may retain closure 100 with container 300, for example, by connecting, coupling, and/or attaching skirt 120 to band 130 while allowing opening of closure 100 relative to container 300. An inverting portion or tab 133 may be provided, which may be configured to contact bead 330 of container 300. Such contact may provide or increase friction between an outer surface 135 and bead 330 to encourage retention of closure 100 in the open position unless and/or until overcome by a user input to re-close container 300 with closure 100, for example. Tab 133, outer surface 135, and/or portions of band 130 and/or skirt 120 may be sized, shaped, and/or configured by providing scores 140 and/or 143.

For example, second score 143 may include a somewhat "U" shaped portion, for example including one or more second areas of separation that might include weakened material or no material such as first vertical score 141 and/or second vertical score 142, as shown in FIGS. 4 and 5. In this embodiment, inverting band portion or tab 133 may be provided and/or facilitated by inclusion of horizontal portion of second score 143, for example, so that a lower area or portion 138 of tamper band 130 may be provided with a substantially continuous and/or substantially uninterrupted perimeter or circumference. Frangible and/or breakable pieces of material may be included between the second horizontal score 143 and either or both of first vertical score 141 and second vertical score 142, for example. It is understood that while a bottom 139 of tamper band 130 in areas adjacent first hinge 151 and second hinge 152 are shown above bead 330 in FIG. 6, in some embodiments those or other areas of tamper band 130 and/or bottom 139 may be retained below bead 330. For example, bead 330 may catch and/or block bottom 139 of tamper band 130 and prevent it from rotating above bead 330 while allowing tab 133 to rotate above bead 330 and snap or lock into place, which may facilitate retaining closure 100 in an open or fully open position.

Figure 8:
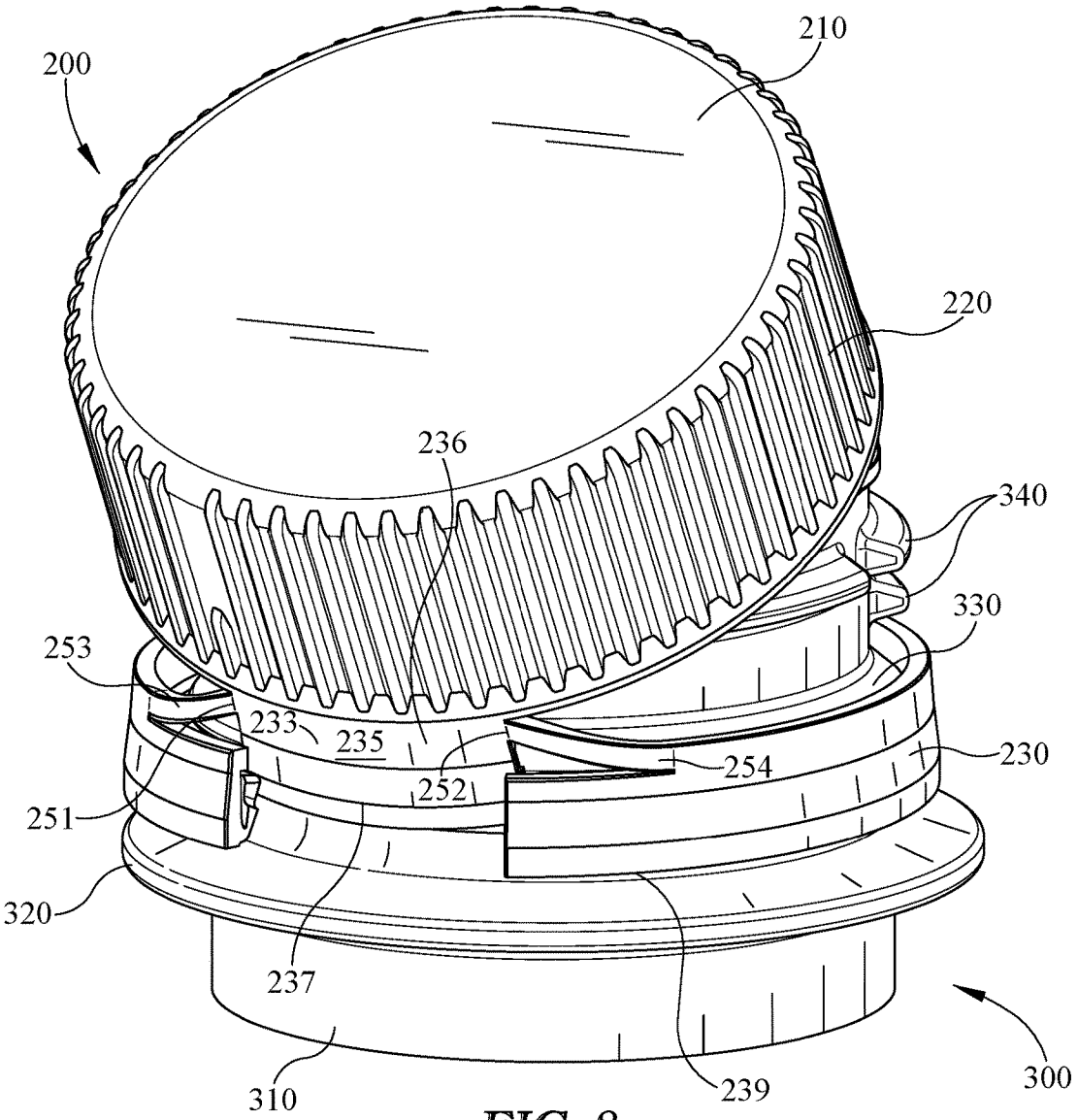
FIG. 8 illustrates a top perspective view of the closure of FIG. 7 in a first open position relative to the container neck.
Figure 9:
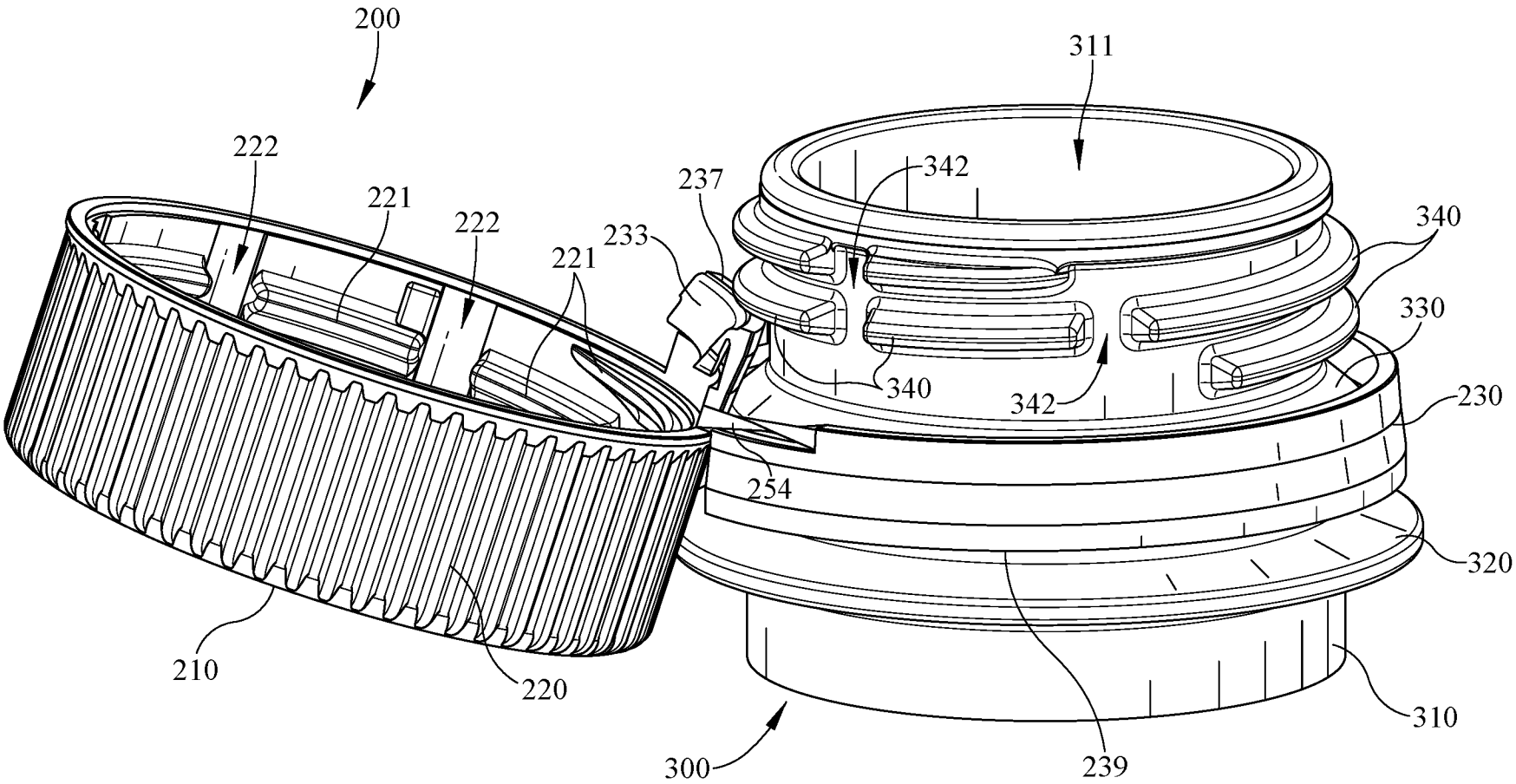
FIG. 9 illustrates a top perspective view of the closure of FIG. 8 in a second open position relative to the container neck.

Another embodiment of a closure 200 is shown in FIGS. 7 through 9, for example, and may be configured for use with container or bottle 300. Closure 200 may include a lid or cover 210 and/or a skirt 220. Lid 210 may be configured to substantially block access to anything in, under, and/or covered by lid 210, such as a product storage region within a container. Skirt 220 may depend from lid 210 and may include an attachment feature such as an internal thread 221 for attachment to a container to be covered by closure 200.

Closure 200 may include a tamper band 230, as shown for example in FIGS. 7 through 9, which may be configured to separate from the rest of closure 200 when removed from an underlying bottle or container 300. Closure 200 and/or tamper band 230 may provide a visual indication to a user that closure 200 has been removed from bottle or container 300 by virtue of the separation of tamper band 230 from the rest of closure 200 and/or skirt 220. Tamper band 230 and/or closure 200 may include a plurality of segments and/or scallops (e.g., similar to segments 31 and/or scallops 32 shown in FIG. 1) to facilitate attachment and/or tamper evident removal of closure 200 from bottle or container 300, or for any other reason. Closure 200 and/or any portion thereof may be configured to be removably attachable to container 300. For example, closure 200 may include one or more internal threads 221 that may be configured to engage corresponding external threads 340 of container 300. If included, either or both threads 221, 340 may include one or more vents 222, 342, which may be provided, for example, to facilitate alleviating, equalizing, and/or slowly releasing pressure that may build up in container 300.

Bead 330 may project outwardly from container neck 310 and/or may engage tamper band 30 and/or tamper band segments to prevent or inhibit tamper band 230 from traveling vertically upward relative to container neck 310. Removal of closure 200 from container 300, for example by rotating to unthread, may cause vertical upward motion relative to container 300. Closure 200 and/or a portion thereof, such as for example skirt 220, may separate from at least a portion of tamper band 230 during unthreading for instance due to the upward motion caused by unthreading skirt 220 contemporaneously with the blocking of upward motion by bead 330.

To facilitate separation of skirt 220 from tamper band 230 while also allowing skirt 220 to remain attached or connected to tamper band 230, or for any other reason, closure 200 may include one or more separation areas or features such as a first score 240, one or more second scores 243, 244, and/or one or more vertical scores such as first vertical score 241 and second vertical score 242, as shown for example in FIG. 7. First score 240 may be a substantially horizontal score that extends around some of the circumference of closure 200 with an area of material between, such as at or near a top portion 236 of a tab 233. It is understood that first score 240 may be configured other than horizontally as shown in FIG. 7, for example, by extending at an angle relative to the horizontal. Vertical scores 241, 242 may be substantially transverse and/or perpendicular to first score 240 to leave an area of material between them and first score 240, such as at a first hinge 251 and/or a second hinge 252, and/or at tab 233. Any or all of scores 240, 241, 242, 243, 244 may be areas or lines of thinned material, frangible material, weaker material, any combination thereof, and/or configured to be more easily separable than surrounding areas of material. Vertical scores 241, 242 may be angled relative to a vertical direction and/or may be configured with a vertical component as well as a horizontal component, although they may be substantially only vertical in some embodiments. The areas of material between the respective scores may create one or more flaps, bridges, and/or hinges or other features, such as hinges 251, 252, and/or tab 233, for example.

Scores 240, 241, 242, 243, 244 and/or hinges 251, 252 may facilitate moving closure 200 between an exemplary closed position shown in FIG. 7 and one or more exemplary open positions such as a first open position shown in FIG. 8 and/or a second open position shown in FIG. 9. For example, a user may twist open closure 200 causing separation of skirt 220 from band 230 at or near horizontal score 240, which may be weaker and/or more easily separable than surrounding areas of skirt 220 and band 230. The user may then rotate closure 200 relative to container 300 into the open position shown in FIG. 9 by rotating skirt 220 relative to band 230 and/or container 300 about either or both straps or hinges 251, 252. Either or both of second or vertical scores 241, 242 may be substantially formed at least partially through the thickness of closure 200 to facilitate rotation of skirt 220 relative to band 230. Either or both hinges 251, 252 may stretch and/or twist to accommodate moving closure 200 between the closed position, the first open position, and/or the second open position. For example, either or both hinges 251, 252 may be formed of a stretchable and/or flexible thermoplastic material such as polypropylene (PP) and/or high-density polyethylene (HDPE).

To facilitate moving closure 200 between a closed position and one or more open positions, or for any other reason, a first strap 253 and/or a second strap 254 may be included. Either or both straps 253, 254 may be provided to give extra length, rotation, and/or flexibility to the material that remains connected between tamper band 230 and skirt 220 even after separation at separation areas 240, 241, 242, 243 and/or 244, which may allow extra movement of skirt 220 relative to tamper band 230 during opening and closing. First strap 253 and/or second strap 254 may be substantially defined at areas of circumferential overlap of first score 240 and second scores 243, 244 on top and bottom, respectively, at one end by the end of first or upper horizontal score 240, and/or at the other end by the end of respective second or lower horizontal score 243, 244. Straps 253, 254 may be adjacent respective hinges 251, 252, or straps 253, 254 may be considered to include respective hinges 251, 252.

Rotation of skirt 220 relative to band 230 may result in a tab 233 that may flip upwardly as shown in FIG. 9. Tab 233 may be provided between first strap or hinge 251 and second strap or hinge 252, may extend from a tab bottom portion 237 to a tab top portion 236, and/or may include material from a portion of at least one of skirt 220 and band 230. Tab 233 may rotate and/or invert about a hinge axis substantially along a line formed through first hinge 251 and second hinge 252. Tab 233 may include an outer surface 235 that may engage container 300, for example at bead 330, when in the open position shown. This contact or engagement of tab 233 with bead 330 may facilitate retaining closure 200 and/or skirt 220 in the open position, for example, by resisting rotation to flip closure 200 back into the closed position. Closure 200 may be configured such that a user may overcome this resistance and selectively close closure 200 relative to container 300 and/or move closure 200 into the closed position shown for example in FIG. 7. Either or both straps or hinges 251, 252 may stretch or be stretched in the open position and/or during transition between open and closed positions. This stretching may induce tension that may facilitate retention in the open position and/or closed position, for example, by increasing friction between tab 233 and/or outer surface 235 and bead 330, and/or the tension may provide or enhance a snap back type hinging mechanism. One or more areas of material such as bridges may be provided to connect and/or provide a frangible connection between tab 233 and the rest of tamper band 233. For example, one or more bridges may connect tab bottom 237 to tamper band bottom 239, although it is understood that one or more bridges, if included, may be located elsewhere, for example, higher up in first vertical score 241 and/or second vertical score 242. If included, any or all bridges included with closure 200, if any, may be similar to bridges 38 shown with respect to closure 5 in FIG. 1.

It is understood that closure 5, 100, 200 and/or container 300, and/or any component thereof, may be made of any of a variety of materials, including, but not limited to, any of a variety of suitable plastics material, any other material, or any combination thereof. Suitable plastics material may include, but is not limited to, polypropylene (PP), polyethylene (PE), polyethylene terephthalate (PET), polystyrene (PS), high-density polyethylene (HDPE), low-density polyethylene (LDPE), linear low-density polyethylene (LLDPE), crystallized polyethylene terephthalate (CPET), mixtures and combinations thereof, or any other plastics material or any mixtures and combinations thereof. It is understood that multiple layers of material may be used for any of a variety of reasons, including to improve barrier properties, or to provide known functions related to multiple layer structures. The multiple layers, if included, may be of various materials, including but not limited to those recited herein.

It is further understood that container 300 and/or closure 5, 100, 200 and/or any component thereof, may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of container 50 and/or closure 100, and/or any component thereof.

It is further understood that any of a variety of processes or combination thereof may be used to form container 300 and/or closure 5, 100, 200 and/or any component thereof, or any layer or substrate used therein. For example, any component, layer, or substrate, or combination thereof, may be compression molded, thermoformed, injection molded, injection stretch blow molded, blow molded, extrusion blow molded, coextruded, subjected to any other suitable process, or subjected to any combination thereof. In some embodiments, container 300 and/or closure 5, 100, 200 and/or any component thereof may be formed substantially of injection molded and/or thermoformed suitable plastics material, although other materials and forming processes may be used instead of or in addition to injection molding and thermoforming, respectively. Various materials and/or processes may be used to form container 300 and/or closure 5, 100, 200 and/or any component thereof, as will be understood by one of ordinary skill in the art. In some embodiments, container 300 and/or closure 5, 100, 200 and/or any component thereof, may be substantially a one-piece design and/or substantially formed as an integral or unitary structure.

Closure 5, closure 100, closure 200, and/or container 300, or any component thereof, may vary in size, shape, geometry, material, and/or process or processes used to make them. For example, in some embodiments, closure 5, 100, and/or 200 may be substantially injection molded polypropylene. The closure may be injection molded with the tamper band and/or segments extended downwardly and/or there may be substantially no physical separation between the tamper band and the rest of the skirt (e.g., one or more scores not yet present). A secondary or subsequent process may be employed, such as a cutting or slitting operation, to cut one or more of the scores into the closure, skirt, and/or tamper band. For example, one or more vertical knives may be used to cut the vertical scores and/or one or more horizontal knives may be used to cut the horizontal scores into the closure. At any time during the cutting operation(s), or any time before or after, the segments may be inverted and/or folded or pushed up into the interior of the closure and/or the tamper band.

In another example, closure 5, 100, and/or 200 may be substantially compression molded HDPE. The closure may be compression molded with the tamper band and/or segments extended downwardly and/or there may be substantially no physical separation between the tamper band and the rest of the skirt (e.g., one or more scores not yet present). A secondary or subsequent process may be employed, such as a cutting or slitting operation, to cut one or more of the scores into the closure, skirt, and/or tamper band. For example, one or more vertical knives may be used to cut the vertical scores and/or one or more horizontal knives may be used to cut the horizontal scores into the closure. At any time during the cutting operation(s), or any time before or after, the segments may be inverted and/or folded or pushed up into the interior of the closure and/or the tamper band.

In a third example, the closure may be injection molded HDPE with the tamper band and/or segments extended downwardly and/or there may be substantially no physical separation between the tamper band and the rest of the skirt (e.g., one or more scores not yet present). A secondary or subsequent process may be employed, such as a cutting or slitting operation, to cut one or more of the scores into the closure, skirt, and/or tamper band. For example, one or more vertical knives may be used to cut the vertical scores and/or one or more horizontal knives may be used to cut the horizontal scores into the closure. At any time during the cutting operation(s), or any time before or after, the segments may be inverted and/or folded or pushed up into the interior of the closure and/or the tamper band.

In a fourth example, closure 5, 100, and/or 200 may be substantially compression molded PP. The closure may be compression molded with the tamper band and/or segments extended downwardly and/or there may be substantially no physical separation between the tamper band and the rest of the skirt (e.g., one or more scores not yet present). A secondary or subsequent process may be employed, such as a cutting or slitting operation, to cut one or more of the scores into the closure, skirt, and/or tamper band. For example, one or more vertical knives may be used to cut the vertical scores and/or one or more horizontal knives may be used to cut the horizontal scores into the closure. At any time during the cutting operation(s), or any time before or after, the segments may be inverted and/or folded or pushed up into the interior of the closure and/or the tamper band. It is understood that in these or other examples, any or all scores, cuts, slits, gaps, slots, and/or areas of weakened material such as a thinned web may be formed during an injection molding and/or compression molding process instead of or in addition to any separate and/or secondary cutting or slitting operations.

It is understood that, while some directional terms are used herein, such as top, bottom, upper, lower, inward, outward, upward, downward, etc., these terms are not intended to be limiting but rather to relate to one or more exemplary orientations, positions, and/or configurations of container 300 and/or closure 5, 100, 200 and/or any component thereof. It is understood container 300 and/or closure 5, 100, 200 and/or any component or portion thereof may be inverted or re-oriented to face or point a different direction without departing from the nature of container 300 and/or closure 5, 100, 200 disclosed herein.

These and other modifications and variations may be practiced by those of ordinary skill in the art without departing from the spirit and scope, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the scope of that which is described in the claims. Therefore, the spirit and scope of the appended claims should not be limited to the exemplary description of the versions contained herein.

That which is claimed:

1. A closure for a container, comprising:

a cover and a skirt depending from the cover;

a tamper band, wherein the skirt is disposed between the cover and the tamper band;

a first separation area extending horizontally around at least about half the circumference of the skirt;

a second separation area that includes a pair of vertical scores formed in the tamper band and extending below the first separation area to at least partially define a tab;

wherein the second separation area extends to the bottom of the tamper band; and a pair of hinges disposed between the pair of vertical scores and the first separation area;

wherein the closure is configured to rotate about a hinge axis that extends through the pair of hinges between a closed position in which the cover blocks access to the container and an open position in which the cover allows discharge of contents from the container;

wherein the tab is configured to engage the container when the closure is in the open position to retain the closure in the open position;

wherein the pair of hinges allow movement of the closure between the closed position and the open position and also retain the skirt to the tamper band.

2. The closure of claim 1, further comprising at least one third separation area extending horizontally below the first separation area away from a top portion of at least one vertical score to define at least one strap between the at least one third separation area and the first separation area.

3. The closure of claim 1, wherein the pair of vertical scores extend to the bottom of the tamper band.

4. The closure of claim 3, wherein at least one frangible bridge connects a bottom area of the tab to a bottom area of the tamper band oppositely disposed at least one of the vertical scores from the tab.

5. A closure for a container, comprising:

a cover and a skirt depending from the cover;

a tamper band, wherein the skirt is disposed between the cover and the tamper band;

wherein the cover, skirt, and tamper band are at least one of injection molded and compression molded;

a first separation area extending horizontally around a portion of a circumference of the closure between the skirt and the tamper band;

a second separation area that includes a first vertical score and a second vertical score extending downwardly below the first separation area to a bottom edge of the tamper band to form a tab between the first vertical score and the second vertical score;

wherein at least one of the first separation area, the first vertical score, and the second vertical score are formed by at least one of a cutting operation and a slitting operation; and a pair of hinges disposed between the pair of vertical scores and the first separation area;

wherein the closure is configured to rotate about a hinge axis that extends through the pair of hinges between a closed position in which the cover blocks access to the container and an open position in which the cover allows discharge of contents from the container;

wherein the tab is configured to engage the container when the closure is in the open position to retain the closure in the open position;

wherein the pair of hinges allow movement of the closure between the closed position and the open position and also retain the skirt to the tamper band.

6. The closure of claim 5, further comprising at least one third separation area extending horizontally below the first separation area from a top portion of at least one vertical score to define at least one strap between the at least one second separation area and the first separation area.

7. The closure of claim 5, wherein the cover, skirt, and tamper band are substantially formed of HDPE.

8. The closure of claim 7, wherein the cover, skirt, and tamper band are compression molded as a unitary piece that is subsequently cut or slit to form the horizontal and vertical scores.

9. The closure of claim 5, wherein the cover, skirt, and tamper band are substantially formed of polypropylene.

10. The closure of claim 9, wherein the cover, skirt, and tamper band are injection molded as a unitary piece that is subsequently cut or slit to form the horizontal and vertical scores.

* * * * *